United States Patent [19]

Tachibana et al.

[11] Patent Number: 4,461,663

[45] Date of Patent: Jul. 24, 1984

[54] METHOD OF MOUNTING A REMOVABLE PRINTING SLEEVE ON A CORE UTILIZING A HOT MELT ADHESIVE

[75] Inventors: Eiichi Tachibana, Toda; Koushou Murayama, Kawasaki; Kenzo Isumi, Kameoka, all of Japan

[73] Assignee: Dai Nippon Insatsu Kabushiki Kaisha, Tokyo, Japan

[21] Appl. No.: 326,500

[22] Filed: Dec. 2, 1981

[30] Foreign Application Priority Data

| | | | |
|---|---|---|---|
| Dec. 4, 1980 | [JP] | Japan | 55-171318 |
| Mar. 5, 1981 | [JP] | Japan | 56-31530 |
| May 22, 1981 | [JP] | Japan | 56-76498 |
| May 22, 1981 | [JP] | Japan | 56-76499 |
| May 22, 1981 | [JP] | Japan | 56-76500 |

[51] Int. Cl.[3] ..... B21H 1/14; B41F 13/10

[52] U.S. Cl. ..... 156/86; 29/148.4 D; 29/447; 101/375; 156/165; 156/229; 156/268; 156/285; 156/294; 156/322; 156/423; 156/344; 156/584; 204/9

[58] Field of Search ..... 29/447, 148.4 D; 101/375; 156/344, 165, 294, 293, 423, 584, 333, 334, 86, 322, 229, 630, 268, 285; 204/9

[56] References Cited

U.S. PATENT DOCUMENTS

| | | | |
|---|---|---|---|
| Re. 28,868 | 6/1976 | Spaeder | 156/294 |
| 1,576,726 | 3/1926 | Davis | 156/294 |
| 2,686,091 | 8/1954 | Young | 156/344 |
| 2,974,367 | 3/1961 | Doering et al. | 156/294 |
| 2,994,359 | 8/1961 | Westbrook et al. | 156/294 |
| 3,014,266 | 12/1961 | Samuels et al. | 29/148.4 D |
| 3,146,709 | 9/1964 | Bass et al. | 101/375 |
| 3,451,112 | 6/1969 | Karmell et al. | 29/148.4 D |
| 3,620,860 | 11/1971 | Eckardt et al. | 156/333 |
| 3,620,878 | 11/1971 | Guthrie | 156/334 |
| 3,718,956 | 3/1973 | Sekimoto et al. | 29/148.4 D |
| 3,846,206 | 11/1974 | Busma et al. | 156/294 |
| 3,872,573 | 3/1975 | Nichols et al. | 29/447 |
| 3,987,122 | 10/1976 | Bartz | 156/334 |
| 4,038,120 | 7/1977 | Russell | 156/584 |
| 4,184,000 | 1/1980 | Denman | 156/293 |

FOREIGN PATENT DOCUMENTS

| | | | |
|---|---|---|---|
| 40-12169 | 6/1965 | Japan | 156/294 |

*Primary Examiner*—Jerome W. Massil
*Attorney, Agent, or Firm*—Koda and Androlia

[57] ABSTRACT

A gravure printing cylinder is formed by fitting a printing sleeve over a core roll via a layer of a hotmelt adhesive. A gravure printing surface with ink-retaining cells is formed on the printing sleeve either before or, preferably, after the mounting of the sleeve on the core roll. For assemblage of the printing cylinder the hotmelt is applied in the molten state to at least part of at least either of the opposed surfaces of the printing sleeve and the core roll. Then the printing sleeve is placed over the core roll, preferably while both sleeve and roll are being heated. The printing cylinder can be readily disassemblaged by remelting the hotmelt layer. Also disclosed herein is an apparatus for the assemblage and disassemblage of the printing cylinder, including a roll holder for holding the core roll in an upstanding attitude while the core roll is being heated by a heating medium circulating therethrough. As a hotmelt applicator removably mounted on a carriage travels down the upstanding core roll to coat same with a hotmelt adhesive, a sleeve mounting pusher removably mounted on another carriage pushes the printing sleeve down onto the adhesive-coated core roll. A sleeve dismounting pusher is to be mounted on either of the carriages for pushing up the printing sleeve off the core roll.

10 Claims, 21 Drawing Figures

METHOD OF MOUNTING A REMOVABLE PRINTING SLEEVE ON A CORE UTILIZING A HOT MELT ADHESIVE

BACKGROUND OF THE INVENTION

This invention relates to the art of printing-platemaking in general and, in particular, to a gravure printing cylinder of the type having a printing sleeve wrapped around a core roll. The invention also particularly concerns a method of, and apparatus for, the assembly of such gravure printing cylinder.

Iron rolls with suitable claddings has long been used as gravure cylinders. Such cylinders have been heavy to handle and costly to prepare. Another problem has arisen from the need for holding the gravure cylinders in storage in the case of printing jobs that might be recorded. Thus, in large-scale printing factories, considerable number of gravure cylinders has had to be constantly kept in storage, demanding considerable space. The transportation of the cylinders from the place of storage to the printing presses, or vice versa, has also been troublesome.

Gravure printing sleeves has recently entered the field to remedy the problems attendant on the solid cylinders. Such sleeves are formed by electroplating one or more thin layers of nickel, copper, chromium, etc., on what is called a mother cylinder, which is of iron with a cladding of stainless steel, nickel, chromium or the like. After grinding the surface of the plated-on sleeve, ordinary ink-retaining cells or depressions characteristic of gravure printing are etched or engraved therein by any known or suitable method, and then the sleeve is withdrawn from over the mother cylinder. The thus-prepared sleeve is fitted over a core roll to provide a gravure printing cylinder for use on a printing press. After each printing run the sleeve is dismounted from the core roll and placed in storage by itself. Such lightweight sleeves are easier to handle than solid cylinders and make it unnecessary to store the expensive cylinders themselves for extended lengths of time.

We have previously proposed in our Japanese patent application No. 55-94265 a method of mounting and dismounting a printing sleeve on and from a core roll. This prior art method dictates the heating of the sleeve to cause its increase in diameter. Since the sleeve of nickel, copper, chromium, etc., is more thermally expansible than the core roll of iron or the like, the former can be readily mounted on the latter with a tight fit and removed therefrom. As has later proved, however, this method is open to further improvement.

The printing sleeve must fit over the core roll tightly enough to preclude the possibility of their relative angular displacement during printing, in spite of the pressure exerted thereon from the impression cylinder. No such angular displacement will normally take place when the sleeve-type cylinder is printing on film or like smooth surfaces, because of relatively low printing pressure required. The printing pressure rises to as high as 10 to 20 kilograms per centimeter when the cylinder prints on rough paper, titanium paper or like poor receptors of ink. The printing sleeve then tends to turn about the core roll because of the high pressure from the impression cylinder as well as the possible deformation of the core roll.

Japanese Patent Laid-Open (Kokai) No. 54-4601, suggests a method of obtaining a firm bond between printing sleeve and core roll. This known method calls for the use of cement, lead alloy or like substance, which is poured in molten state into a space intentionally created between printing sleeve and core roll. This method requires the core roll to be of minimal out-of-roundness, and the filler demands a prolonged length of time for solidification. An even more serious disadvantage is that, once the printing sleeve and core roll are bonded together with such a filler, they cannot possibly be disassembled unless the sleeve is torn apart or the filler is broken as by hammering. In either way the printing sleeve cannot be dismounted in reusable form.

SUMMARY OF THE INVENTION

The present invention seeks to provide an improved gravure printing cylinder wherein a printing sleeve is firmly bonded to a core roll in exact axial alignment and against any possibility of angular displacement during printing. The bond is such, moreover, that the printing sleeve can be readily withdrawn from over the core roll in a state permitting reuse of the sleeve. The invention also seeks to provide a method of assembling such a gravure printing cylinder which can be easily disassembled when necessary, and an apparatus for use in the practice of the method.

The gravure printing cylinder in accordance with the invention features a layer of a hotmelt adhesive interposed between the printing sleeve and the core roll for firmly bonding them together. The term "hotmelt adhesive" or simply "hotmelt," as used herein and in the claims appended hereto, should be understood to mean any solid, thermoplastic adhesive which melts upon heating and then sets to a firm bond on cooling. Besides providing a sufficiently strong bond between printing sleeve and core roll, the hotmelt layer therebetween can be remelted, after the use of the gravure printing cylinder, to allow removal of the sleeve in reusable form.

Preferably the printing sleeve has an inner diameter less than the diameter of the core roll at room temperature. In being placed around the core roll over an interposed hotmelt layer, at least the printing sleeve is heated until its inner diameter becomes at least approximately equal to the diameter of the core roll. Thus assembled, the printing sleeve tightly fits over the core roll upon cooling and so is secured thereto both with the adhesive and with the tight fit. Both printing sleeve and core roll can be heated to the same temperature if the former is of more thermally expansible material than the latter.

According to another feature of the invention, the printing sleeve, which is formed as aforesaid by electroplating a mother cylinder, is temporarily subjected to circumferential tensile stress before being closely fitted around the core roll over a hotmelt layer. Pretreated in this manner, the printing sleeve will not suffer permanent circumferential elongation no matter how many times it is thereafter mounted on and dismounted from the core roll.

Basically the invention permits the etching or engraving of ink-retaining cells in the printing sleeve either before or after it is mounted on the core roll. For the best results, however, such cells are formed in the printing sleeve after it has been mounted on the core roll in the above described manner.

The apparatus according to the invention is well calculated to single-handedly perform the jobs of assembling and disassembling the gravure printing cylinder. Included in this apparatus is a roll holder for holding the core roll in a prescribed, preferably upstanding, attitude while the core roll is being heated. During assembly, as a hotmelt applicator removably mounted on a carriage travels down the heated core roll for coating the same with a hotmelt, a sleeve mounting pusher removably mounted on another carriage pushes the printing sleeve down onto the adhesive-coated core roll. For disassembly a sleeve dismounting pusher is mounted on either of the two carriages for pushing up the printing sleeve off the heated core roll.

Thus, according to this apparatus, the hotmelt is applied as coating on the upstanding core roll being heated, and immediately thereafter or almost concurrently therewith, the printing sleeve is pushed down onto the roll. The molten adhesive forms a layer of unvarying thickness between printing sleeve and core roll, establishing a firm bond on cooling. The removal of the printing sleeve is no less easy. Since the adhesive layer is remelted by heating the core roll, the printing sleeve can be readily slipped out of the core roll when pushed up by the sleeve dismounting pusher.

The above and other features and advantages of this invention and the manner of attaining them will become more apparent, and the invention itself will best be understood, from a study of the following description with reference had to the attached drawings.

DETAILED DESCRIPTION OF THE INVENTION

Gravure Printing Cylinder

Figure 1:
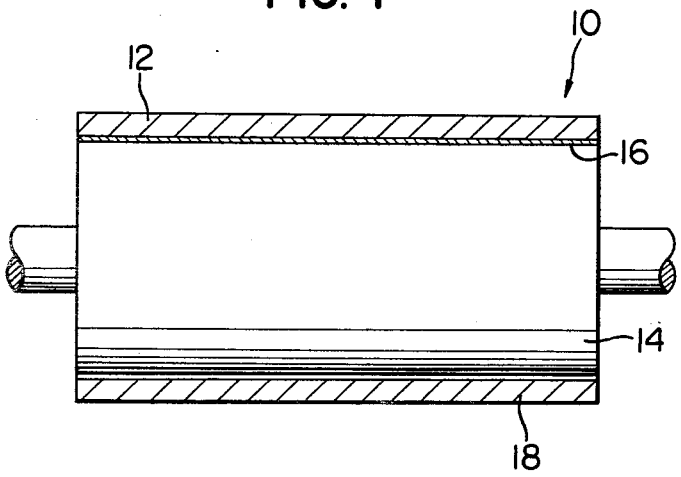
FIG. 1 is a side view, partly in longitudinal section, of a preferred form of the gravure printing cylinder incorporating the novel concepts of the present invention.

With reference first to FIG. 1, a typical gravure printing cylinder in accordance with the invention is therein generally designated by reference numeral 10. It includes a printing sleeve 12 closely fitted over a core roll 14 and bonded thereto over a layer 16 of a hotmelt adhesive. As has been known heretofore, the printing sleeve 12 is of a single layer or two or more laminated metal layers, usually formed by electroplating, whereas the core roll 14 is ordinarily of iron, with a plated-on covering of chromium or the like for rustproofing. The printing sleeve 10 bears a gravure printing surface 18 with the usual ink-retaining cells, not shown, which can be formed either before or after the sleeve is fitted over and bonded to the core roll 14.

Figure 2:
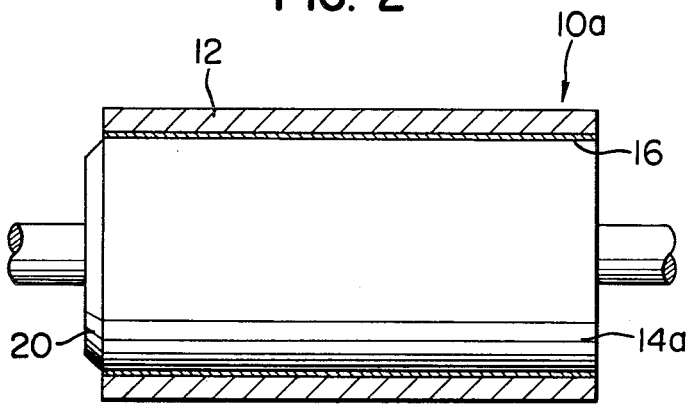
FIG. 2 is a view similar to FIG. 1 but showing a modified form of the gravure printing cylinder.

FIG. 2 shows a modified gravure printing cylinder **10*a* in accordance with the invention. The modified cylinder 10*a* has a core roll 14*a* of slightly greater axial dimension than that of the printing sleeve 12, with one end of the core roll projecting beyond the printing sleeve. The projecting end of the core roll 14*a* has its circumferential edge beveled at 20 to facilitate the mounting and dismounting of the printing sleeve 12. The bevel 20** is particularly useful in fitting the printing sleeve over the core roll, because the two members need not be in precise axial alignment just before the insertion of the core roll into the sleeve.

Method

For the preparation of the gravure printing cylinder 10 or **10*a* by the method of this invention, a hotmelt adhesive is applied in the molten state to at least part of at least either of the inside surface or the printing sleeve 12 and the surface of the core roll 14 or 14*a*. The hotmelt can be applied to the core roll 14 by either rolling or dipcoating. Preferably, as in the apparatus disclosed herein, there may be employed an annular trough containing a molten hotmelt and slidably fitted over the core roll 14** held in an upstanding attitude. The trough is configured to hold the hotmelt in direct contact with the core roll. By sliding this trough down the core roll, therefore, the hotmelt can be applied as a uniform coating on its surface. During such coating with the hotmelt, the core roll may be heated as by circulating a heating liquid or gas therethrough. Alternatively the core roll may be preheated as with an electric or infrared heater, by being dipped in a bath of heated water, or by being kept in an atmosphere of heated air.

The printing sleeve 12 can be slipped onto the core roll 14 immediately after, or concurrently with, the travel of the hotmelt-containing trough down the upstanding roll. Upon subsequent cooling of the core roll and the printing sleeve, either by being forced to cool or by being allowed to stand at room temperature, the hotmelt solidifies to provide a firm bond therebetween.

As required or desired, a multiplicity of small depressions may be formed all over the core roll 14 for receiving the hotmelt prior to the mounting of the printing sleeve 12 thereon. In this manner, even if hard solids are caught between the printing sleeve and the core roll during assembly, the depressions will accommodate such solids and so prevent them from deforming the gravure printing surface 18 of the sleeve.

Irrespective of whether the depressions are formed in the core roll 14 or not, the hotmelt need not be applied as coating over the entire outer surface of the core roll and/or over the entire inside surface of the printing sleeve. It may be applied, for example, only to the end portion of the core roll and/or of the printing sleeve where they start mating in assembly. As the mating of the two members progresses, the hotmelt will gradually spread over their entire opposed surfaces, forming the layer 16.

The assembly of the gravure printing cylinder in accordance with the invention will also be facilitated if a suitable number of small holes are created in the core roll for the emission of air at room or elevated temperatures during the mounting of the printing sleeve thereon. The use of heated air in particular is desirable as it serves to remelt the adhesive and hence to make smoother the mounting, as well as dismounting, of the printing sleeve.

In order to realize a still firmer union of the printing sleeve 12 and the core roll 14, the inner diameter of the sleeve is made slightly less than the roll diameter at room temperature. Only the printing sleeve is heated prior to its mounting on the core roll, to such an extent that its inner diameter becomes greater than, or approximately equal to, the diameter of the core roll. Then the heated printing sleeve is mounted on the core roll over the molten adhesive. When cooled subsequently, the printing sleeve will contract into a tight fit with the core roll, while the adhesive will solidify, filling the entire gap between sleeve and roll. Thus is the printing sleeve positively secured to the core roll both with the tight fit and with the adhesive. The heating of the printing sleeve serves also to remelt, or hold molten, the adhesive coating thereon and/or on the core roll.

Alternatively the printing sleeve and the core roll can both be heated to approximately the same temperature to obtain a tight fit therebetween, provided that the printing sleeve is of material having a higher coefficient of expansion than that of the material of which the core roll is made. In this case, too, the inner diameter of the printing sleeve is made slightly less then the core roll diameter at room temperature. Both the printing sleeve and the core roll are heated at the time of assembly to such a temperature that the sleeve inner diameter becomes greater than, or approximately equal to, the roll diameter. Then the printing sleeve is fitted over the core roll over the molten adhesive. The desired tight fit is obtained, and the adhesive sets, upon subsequent cooling of the printing sleeve and the core roll.

Direct application of heat to both printing sleeve and core roll is not a necessity. For example, as the core roll is heated as above by circulating a heated fluid therethrough, the printing sleeve will be heated by heat transfer from the roll.

Figure 3:
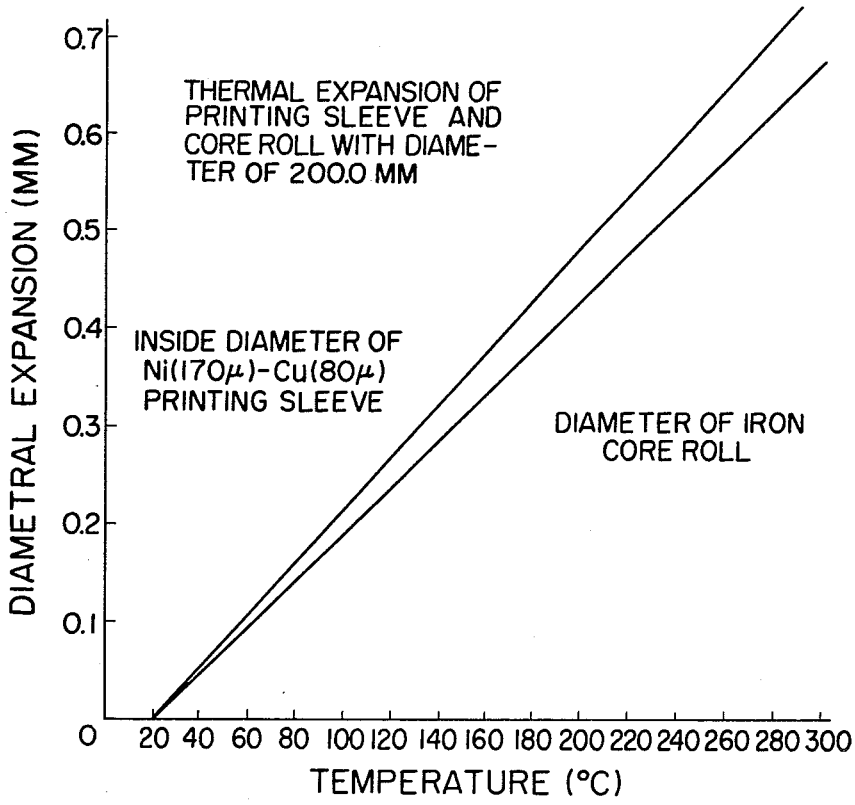
FIG. 3 is a graph explanatory of the difference between the rates of thermal expansion of the printing sleeve and core roll constituting the gravure printing cylinder.

FIG. 3 graphically represents the rates of thermal expansion of a printing sleeve of laminated nickel and copper layers, and of a core roll of iron. The nickel layer of the tested printing sleeve was 170 microns, and the copper layer 80 microns, in thickness. In practice, however, the total thickness of the printing sleeve may be anywhere between 100 and 600 microns. The inner diameter of the tested printing sleeve and the diameter of the tested core roll were both 200 millimeters (mm). It will be noted from the graph that the rate of expansion of the printing sleeve is higher than that of the core roll. Thus, even if the inner diameter of the printing sleeve is less than the diameter of the core roll at room temperature, the sleeve inner diameter can be made greater than, or equal to, the roll diameter by heating both of them to an appropriate temperature.

Basically the invention allows the use of all types of hotmelt adhesives. A few desirable requirements exist, however, such as the ability to offer a good metal-to-metal bond and a rather low melting temperature. More important is low rigidity on setting. Gravure cylinders in general are subjected to exceedingly high printing pressures in use. Should the adhesive layer between printing sleeve and core roll be of high hardness, it might bite into the sleeve in the operation of the cylinder, making its printing surface uneven. Such an uneven printing surface represents a serious impediment to the production of faithful prints.

From the foregoing considerations the invention suggests the use of those hotmelt adhesives which have a Shore hardness of up to approximately A60° on setting. Experiment has proved that such hotmelts offer a cushioning effect between sleeve and roll and do not deform the sleeve under the high working pressures of the gravure cylinder. This is obviously because the soft adhesive layer yields when pressed by the printing sleeve, instead of resisting such pressures and biting into the sleeve. With its printing surface thus kept free from unevenness, the printing sleeve will make beautiful prints for any long runs.

Low rigidity on setting is not the sole determinant in the choice of the adhesive for use in the practice of the invention. As has been pointed out, the selected adhesive must provide sufficient metal-to-metal bonding strength. It has been confirmed by experiment that the printing sleeve suffers no angular displacement on the core roll even at a printing pressure of 20 kilograms (kg) per centimeter (cm) if the 90° peel strength of the adhesive with respect to chromium and nickel surfaces is more than 0.3 kg/cm, and if its shear strength under tension loading is more than 1.0 kg/cm$^2$.

Various types of hotmelts are available for use for the purposes of the invention. Examples are ethylene-vinyl acetate (EVA) copolymer, polyamide, polyester, polyethylene, polypropylene, epoxy-phenolic, and synthetic rubber. Rubber, polyester, and EVA hotmelts in particular meet all the listed requirements of the invention. Rubber hotmelts are recommended among others, as they afford a strong metal-to-metal bond, have low rigidity on setting, and are adhesive even at room temperature. Blended adhesives with a low melting point and low viscosity represent another favorable choice, in consideration of their ease of coating. Styrene-butadiene rubber (SBR), for example, is miscible in desired proportions with rosins and waxes, providing, in combination with a suitable wax, an adhesive that melts in a temperature range of 50° to 80° C. or so.

The following is a list of other commercially available hotmelts (all made by Japanese manufacturers) suitable for use in the practice of the invention: RS 80 (trademark for an EVA hotmelt manufactured by Asahi Kagaku Gōsei K.K.), #1500 (trademark for a series of styrene-isoprene-styrene copolymer hotmelts manufactured by Hirodain Kōgyō K.K.), HM-A-979 (trademark for an EVA hotmelt manufactured by Saiden Kagaku K.K.), and Byron Resin (trademark for a polyester hotmelt manufactured by Tōyō Bōseki K.K.).

Without the use of hotmelts as taught by the present invention, the printing sleeve and the core roll have heretofore demanded a closer fit therebetween to resist relative angular displacement during their use as the gravure printing cylinder. Such a closer fit has required the heating of the printing sleeve to a higher temperature to cause its diametral expansion to a greater degree within the elastic limit. The use of a hotmelt in accordance with the invention makes it possible to assemble and disassemble the gravure printing cylinder by heating at least the printing sleeve to a much lower temperature. Further the printing sleeve can be secured to the core roll both with the tight fit and with the adhesive, practically against any possibility of angular displacement on the core roll during printing. No excessively tight fit is required; indeed, in jobs with comparatively low printing pressures, the printing sleeve will undergo no displacement on the core roll, thanks to the interposition of the adhesive layer therebetween, even if the printing sleeve has an inner diameter approximately equal to or even greater than the diameter of the core roll at room temperature.

The gravure cylinder prepared as described above is mounted on the printing press for printing in the usual manner. For removing the printing sleeve from the core roll after a required run of printing, the adhesive layer therebetween may be heated through at least either of the sleeve and the roll. The adhesive will remelt when heated. Also, even if the printing sleeve has been tightly fitted over the core roll, it will expand until its inner diameter becomes greater than the diameter of the roll on being heated to an appropriate temperature. Thus the printing sleeve can be readily withdrawn from over the core roll and placed in storage pending the issuance of a reorder.

As the printing sleeve is repeatedly mounted on and dismounted from the core roll, however, the fit therebetween may gradually loosen. Although the printing sleeve is nevertheless secured to the core roll by the adhesive layer, such a loose fit can adversely affect the quality of prints, particularly if the adhesive in use is of low rigidity at room temperature. The looseness arises from a gradual increase in the diameter of the printing sleeve, which is of minimal thickness (100–600 microns). Printing sleeves in general are formed by electroplating a mother cylinder with one or more metals and then by withdrawing the plating therefrom. The method of this invention includes an incidental step of processing such electroformed printing sleeves, prior to their mounting on core rolls, to prevent their diametral elongation in use. The following description will make clear how this objective is attained.

A study of the behavior of electroformed printing sleeves, fresh off the mother cylinder, under circumferential tensile load has revealed a peculiar stress-strain relationship. When initially subjected to the maximum circumferential tensile load within the proportional limit and then released from the load, the sleeves do not regain their original diameter; that is, they suffer permanent elongation. After the initial temporary loading, however, the sleeves exhibit elongation proportional to stresses not more than that initially applied, and when released from the stresses, contract with the same proportionality to the diameter they have previously attained by the permanent elongation. This holds true no matter how many times the loading and unloading of the sleeves are repeated thereafter. It is thus seen that electroformed printing sleeves undergo permanent elongation only when initially loaded with circumferential tensile stress, but thereafter behave like ordinary elastic materials.

From the foregoing findings the present invention proposes the application of temporary circumferential tensile load to the printing sleeve, fresh off the mother cylinder, to cause its increase in diameter, instead of immediately mounting the sleeve on the core roll over a hotmelt. The initial tensile stress is normally less than the proportional limit of the particular printing sleeve in use, although the stress may exceed the proportional limit without running counter to the purpose of this pretreatment. Thus subjected to temporary circumferential tensile load and so expanded in diameter, the printing sleeve will retain its increased diameter throughout the rest of its useful life in spite of repeated mounting on and dismounting from the core roll. Whenever mounted on the core roll, therefore, the printing sleeve will make a close fit therewith via the adhesive layer and so produce high-quality prints even under very high printing pressures.

Figure 4:
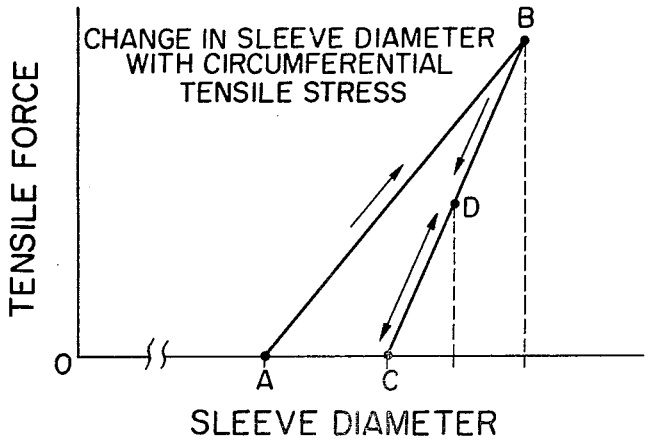
FIG. 4 is a graph plotting the change in the diameter of the electroformed printing sleeve with circumferential tensile stress.

FIG. 4 is a graphic summary of the above discussed behavior of the electroformed printing sleeve under circumferential tensile load, plotting the relationship between the load and the sleeve diameter. The letter A in this graph indicates the state at zero load at the original diameter of the printing sleeve, i.e., the diameter just after the withdrawal of the sleeve from the mother cyliner on which it has been electroformed. The sleeve diameter increases to B upon exertion of the initial circumferential tensile load thereon within its proportional limit. When released from the load, the sleeve diameter is reduced to C, which is greater than the original diameter A. Thus the initial tensile loading of the sleeve causes an increase in its diameter from A to C. After this pretreatment, however, the sleeve diameter varies only between B and C with repeated exertion of circumferential tensile stresses not exceeding that initially applied. If the printing sleeve when pressfitted over the core roll has its diameter increased from C to D, for instance, then the diameter returns to C when the sleeve is dismounted from the roll at the end of a required run of printing. The normal sleeve diameter remains at C despite repeated assembly and disassembly of the gravure printing cylinder.

The method of this invention dictates, of course, the mounting of the above pretreated printing sleeve on the core roll over a layer of a hotmelt. The interposition of the adhesive layer serves to make greater the tolerance of the sleeve diameter after the pretreatment, besides providing a firm bond between sleeve and roll.

As has been stated, the gravure printing surface with the ink-retaining cells can be formed on the printing sleeve either before or after it is mounted on the core roll without departure from the scope of the invention. The conventional practice has been to etch or engrave such cells in the sleeve just formed by plating on the mother cylinder, immediately after grinding of its surface. The mother cylinder has an iron core with a cladding of another metal for the easy release of the plating. The printing sleeve is removed from over the mother cylinder after the creation of the cells therein.

An objection to this conventional practice is that the plated-on sleeve does not necessarily stick fast to the mother cylinder. There are several reasons for this. First, the mother cylinder has the noted cladding of stainless steel, nickel, chromium or like metal intended for ready release of the plating. Further, the plating of one or more metal layers on the mother cylinder easily comes off the cylinder because of the addition of a stress relieving agent to the plating bath. When ground, therefore, the sleeve may undergo angular displacement on the mother cylinder or may bulge out in parts, thus giving rise to inaccuracies in the creation of a fine pattern of cells therein. Such inaccuracies become all the more pronounced when the cells are cut out by electronic engravers, which are finding ever-increasing acceptance in the printing industry with the recent development of electronics. An additional reason for the displacement or deformation of the plated-on sleeve on the mother cylinder is its permanent elongation when initially subjected to tensile stress within the proportional limit, as has been explained in relation to FIG. 4. Thus the grinding of the sleeve preparatory to the creation of cells therein can cause its permanent deformation and displacement on the mother cylinder.

The foregoing will have made clear that the conventional platemaking practice is not necessarily desirable. Accordingly, the invention recommends the etching or engraving of cells in the sleeve after it has been mounted on and bonded to the core roll. The sleeve electroformed on the mother cylinder is removed therefrom in the blank state. Preferably after being temporarily subjected to circumferential tensile stress, the sleeve is placed over the core roll of slightly greater diameter than the mother cylinder over a hotmelt layer while being heated. Then the sleeve on the core roll is ground smooth and etched or engraved to form cells. Since then the sleeve is tightly fitted over and firmly bonded to the core roll against any possibility of displacement or deformation, the image area formed thereon can more faithfully reproduce the original than when cells are created before removal of the sleeve from the mother cylinder.

Given below are some Examples of the method of this invention as actually experimented by the inventors. These Examples should therefore be construed merely to illustrate or explain and not to impose limitations upon the invention.

EXAMPLE I

A printing sleeve, with ink-retaining cells already formed therein, consisting of a nickel layer with a thickness of 130 microns, a copper layer with a thickness of 150 microns, and a chromium layer with a thickness of eight microns was prepared. The axial length of the sleeve was 800 mm, and its inner diameter 200 mm. The core roll on which the sleeve was to be mounted was of iron with a chromium cladding and had an axial length of 800 mm and a diameter greater than the inner diameter of the sleeve by 0.03 mm at room temperature.

The printing sleeve was heated to 120° C. in a tubular electric heater made of two-kilowatt Nichrome (trademark for a nickel-iron-chromium-carbon alloy) wire. The heating of the sleeve caused an increase in its inside diameter by 0.29 mm. In mounting this sleeve on the core roll, 30 grams (g) of the EVA hotmelt HM-A-879 (trademark of Saiden Kagaku K.K.) (melting point 87° C. and Shore hardness about A55°) was applied as coating in the molten state on the inner surface of the sleeve at only its end portion to be first placed over the core roll. When fitted over the core roll, itself preheated to 80° C., the sleeve could be easily mounted in position thereon, with the hotmelt spread uniformly over the entire surface of the roll. The sleeve contracted into a tight fit with the core roll upon cooling, and the hotmelt set to establish a firm union therebetween.

The gravure printing cylinder thus fabricated was mounted on a printing press and put to use. The printing sleeve underwent no angular displacement whatsoever on the core roll during printing. The cylinder produced prints on rough paper with apparent fidelity at a printing pressure of as high as 15 kg per cm of its axial dimension.

After a run of 50,000 m, the printing cylinder was dismounted from the press, cleaned of the gravure ink, and heated to 100° C. by the noted electric heater. The heat remelted the adhesive and caused expansion of the sleeve to a greater extent than the core roll, making it possible to readily withdraw the sleeve from over the core roll. The sleeve was placed within an enclosure for convenient storage pending reuse.

EXAMPLE II

A printing sleeve was employed which consisted of a nickel layer with a thickness of 170 microns, a copper layer with a thickness of 80 microns, and a chromium layer with a thickness of seven microns. The axial length of the sleeve was 700 mm, and its inside diameter 185 mm. Gravure cells had been preformed in the sleeve. A core roll of iron with a chromium cladding, having an axial length of 700 mm and a diameter approximately equal to the inner diameter of the sleeve at room temperature was used.

The printing sleeve was heated to 150° C. in the tubular electric heater made of 2-kw Nichrome wire. The inner diameter of the heated sleeve was increased by 0.33 mm. The core roll was also heated to 150° C. and coated with 40 g of the styrene-isoprene-styrene copolymer hotmelt #1505 (trademark of Hirodain Kōgyō K.K.) (melting point 90° C. and Shore hardness about A20°) in molten state. Even though the inner diameter of the printing sleeve and the diameter of the core roll were approximately the same at room temperature, and both were heated to the same temperature, the diametral expansion of the core roll was only 0.29 mm compared with the 0.33 mm expansion of the printing sleeve, so that the sleeve could be easily fitted over the roll over the adhesive layer. Upon cooling, the bonded joint between sleeve and roll had a shear strength under tensile loading of well over 10 kg/cm$^2$.

The gravure printing cylinder prepared as described above was mounted on a printing press and put to use. The cylinder made faithful reproductions on titanium paper, a poor receptor of ink, to a length of 3,000 m. The printing sleeve underwent no angular displacement whatsoever on the core roll. After the run of 30,000 m, the gravure printing cylinder was heated to a temperature above the melting point (90° C.) of the synthetic rubber hotmelt in use. The printing sleeve could be readily withdrawn from over the core roll.

EXAMPLE III

A printing sleeve which consisted of a nickel layer with a thickness of 130 microns, a copper layer with a thickness of 150 microns, and a chromium layer with a thickness of eight microns was employed. The axial length of the sleeve was 500 mm, and its inside diameter 200 mm. Gravure cells had been preformed in the sleeve. A core roll to mate with the sleeve was of iron with a chromium cladding, having an axial length of 500 mm and a diameter equal to the inner diameter (200 mm) of the printing sleeve at room temperature. The hotmelt used was a mixture of 40% SBR, 30% rosin, and 30% wax, having a melting point of 60° C. a Shore hardness of A25°, and a 90° peel strength of 670 g/cm with respect to nickel and chromium surfaces.

The core roll was heated to 80° C. in a bath of heated water, and the hotmelt was rolled in the molten state over the entire surface of the heated core roll. Although the hotmelt had a viscosity of as high as 10,000 centipoises at the time of application on the core roll, it could be coated easily. The printing sleeve was fitted over the core roll immediately after the rolling of the adhesive thereon. While being thus fitted over the core roll, the sleeve increased in diameter by heat transfer from the roll, to a greater extent than the roll. The sleeve could therefore be easily mounted on the roll over the adhesive layer. The thickness of this adhesive layer on cooling averaged approximately 20 microns.

The thus-prepared gravure printing cylinder was mounted on a printing press and put to use. The printing sleeve suffered no angular displacement or torsional deformation on the core roll even at a printing pressure of 20 kg per cm of axial dimension, obviously by virtue of the cushioning effect ordered by the low-rigidity adhesive layer. The cylinder produced prints on thin paper that were excellent in apparent fidelity, printing pitch, and other respects.

After a run of 100,000 m, the printing cylinder was dismounted from the press, cleaned of the ink, and heated to 80° C. The printing sleeve could be easily withdrawn from over the core roll. Although the permeation of the ink solvent into the adhesive layer from the opposite ends of the cylinder had been feared, such solvent permeation took place in places only to an extent of several millimeters. The printing sleeve upon removal from the core roll had its inside surface washed clean of the adhesive with toluene and was encased for storage.

By way of comparison the method of Example III was repeated with the use of an EVA hotmelt having a melting point of 80° C. and a Shore hardness of A83° on setting in order to make sure that such rigid adhesives are not quite suitable for use with gravure printing cylinders of the type under consideration. The other details of experimentation were exactly as set forth above. When the gravure printing cylinder prepared with the use of the rigid hotmelt was put to use under high printing pressure, the almost unavoidable surface irregularities of the adhesive layer caused corresponding surface undulations of the printing sleeve, the undulations varying in depth or height by several microns. The gravure printing surface of the sleeve was impaired to such an extent as to produce stains on the prints.

EXAMPLE IV

This Example was intended to demonstrate the advantageous effect of temporarily exerting circumferential tensile stress on electroformed printing sleeves preparatory to their mounting on core rolls. A printing sleeve was formed by electroplating nickel to a thickness of 170 microns, copper to a thickness of 80 microns, and chromium to a thickness of 10 microns, on a mother cylinder. The axial length of the sleeve was 700 mm. The inner diameter of the sleeve just withdrawn from over the mother cylinder (corresponding to A in the grath of FIG. 4) was 199.91 mm but was intended to increase to 200.00 mm when the sleeve was subsequently mounted on a core roll (D in FIG. 4).

A tensile load of approximately two metric tons was applied to the printing sleeve in its circumferential direction, with a consequent increase in its inner diameter to 200.08 mm (B in FIG. 4). Upon release of the load, the sleeve contracted to 199.96 mm in inner diameter (C in FIG. 4), 0.04 mm short of the intended diameter on the core roll. This sleeve was then fitted over the core roll, while both were being heated, over a hotmelt. After printing operation with the cylinder on a press, the sleeve was removed from the core roll. The assembly of the printing cylinder, its use on the press, and its disassembly were repeated several times. The inner diameter of the sleeve returned to 199.96 mm each time it was dismounted from the core roll. No angular displacement of the sleeve on the core roll took place during printing, and the quality of the reproduction was highly favorable.

EXAMPLE V

The purpose of this Example was to confirm the above explained fact that the etching or engraving of gravure ink-retaining cells in a printing sleeve after its mounting on a core roll, rather than before its dismounting from the mother cylinder on which it had been electroformed, leads to the most faithful reproduction of the original. For the production of a printing sleeve, a mother cylinder was used which was of iron with a nickel cladding, having an axial length of 700 mm and a diameter of 200.00 mm at room temperature. After degreasing the motor cylinder and coating the same with a release agent, it was plated with nickel in a nickel sulfamate bath to a thickness of 150 microns. Copper was then plated over the nickel plating in a copper sulfate bath to a thickness of 250 microns. The thus-fabricated sleeve was rolled and then withdrawn from over the mother cylinder. The rolling could have been done immediately after the nickel plating. (For easier release of the sleeve from the mother cylinder a stress relieving agent may be added to the nickel plating bath, and the mother cylinder may be heated at the time of the rolling.)

The sleeve with a thickness of 400 microns was then fitted, over a hotmelt, over a core roll of chromium-clad iron while the latter was being heated to 90° C. The core roll had an axial length of 700 mm and a diameter of 200.03 mm at room temperature. Upon cooling, the sleeve was positively secured to the core roll both with the adhesive and with a tight fit, the diameter of the core roll being 0.03 mm more than that of the mother cylinder at room temperature. Then, after grinding the outer copper layer of the sleeve, ink-retaining cells were formed therein by means of a Helio Klischograph (trademark for an electronic egraver manufactured by Dr.-Ing. Rudolf Hell, GmgH, of West Germany). The image thus formed on the sleeve was of utmost accuracy, and the prints made therefrom were of equally good quality. After printing, the gravure printing cylinder was dismounted from the press and heated for withdrawal of the printing sleeve from over the core roll. The sleeve was washed and placed in storage within an enclosure pending a reorder.

Apparatus

Figure 5:
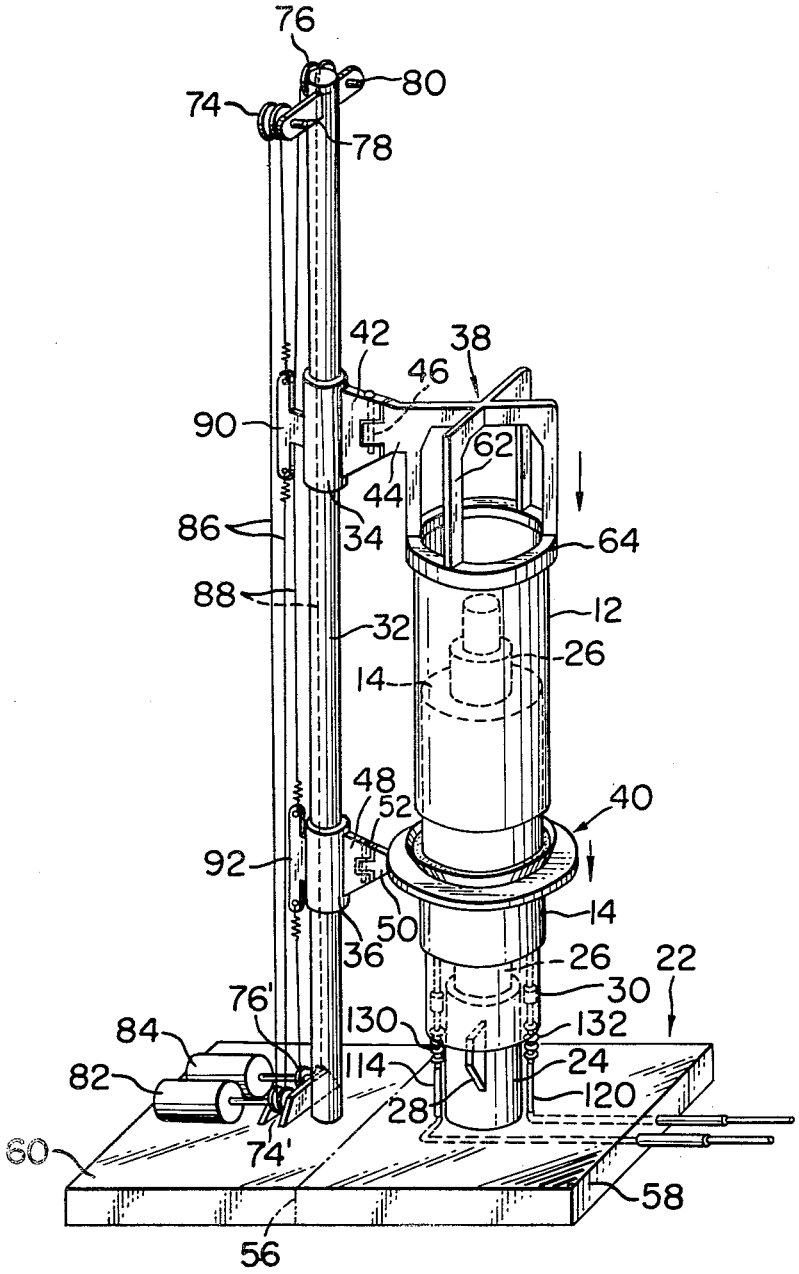
FIG. 5 is a perspective view of the apparatus for the assembly and disassembly of the gravure printing cylinder in accordance with the invention, the apparatus being shown fitted out for assembly of the cylinder and in the act of mounting the printing sleeve on the core roll.

The following is a description of the apparatus for assembling and disassembling the gravure printing cylinder by the method of this invention. FIG. 5 shows the apparatus as fitted out for mounting the printing sleeve 12 on the core roll 14 over a hotmelt in the assembling of the printing cylinder. The apparatus includes a pedestal 22 on which there is fixedly mounted a roll holder 24 for immovably holding the core roll 14 in an upstanding attitude during the mounting and dismounting of the printing sleeve 12 on and from the roll. Generally cylindrical in shape, the roll holder 24 incorporates a mechanism for gripping one of opposite end journals 26 of the core roll 14. The gripping mechanism is not specifically illustrated because of its conventional nature; a familiar chuck, as of the adjustable jaw or collet type, will serve the purpose. Although not absolutely required during assembly of the printing cylinder, the gripping mechanism is a necessity for its disassembly because then the printing sleeve is pushed up for withdrawal from over the core roll.

The roll holder 24 has two or more angularly spaced fins 28, one seen, projecting radially outwardly therefrom for internally engaging and supporting a short tube 30 in axial alignment with the core roll 14 on the roll holder. This tube 30 forms a downward extension of the core roll during assembly of the printing cylinder and performs a function that will become apparent as the description proceeds.

Also erected on the pedestal 22 is a guide column 32 extending parallel to the axis of the core roll 14 on the roll holder 24. The guide column 32 has two tubular carriages or sliders 34 and 36 slidably fitted thereon for independent up-and-down motion. The upper carriage 34 carries a sleeve mounting pusher 38 engageable with one end of the printing sleeve 12 for pushing the same down onto the core roll 14. The lower carriage 36, on the other hand, carries a hotmelt applicator 40 for applying a coating of molten hotmelt over the entire surface of the core roll 14. The upper carriage 34 has a bracket 42 to which a lug 44 of the sleeve mounting pusher 38 is coupled via an upright pivot pin 46, so that the pusher is pivotable about the vertical axis to and away from a position of register with the core roll 14 on the roll holder 24. The lower carriage 36 has a similar bracket 48 to which a lug 50 of the hotmelt applicator 40 is coupled via an upright pivot pin 52. The hotmelt applicator is therefore also pivotable about the vertical axis of the pin 52 to and away from a position of register with the roll holder 24. A withdrawal of the pivot pins 46 and 52 permits disconnection of the pusher 38 and the applicator 40 from their respective carriages 34 and 36.

As desired or required, the pedestal 22 may be bisected along a phantom line 56 into a first half 58 supporting the roll holder 24 and a second half 60 supporting the guide column 32. The first pedestal half 58 may be wheeled or otherwise made mobile for carrying the core roll 14, with or without the printing sleeve 12, away from and back to the fixed location of the second pedestal half 60.

Figure 6:
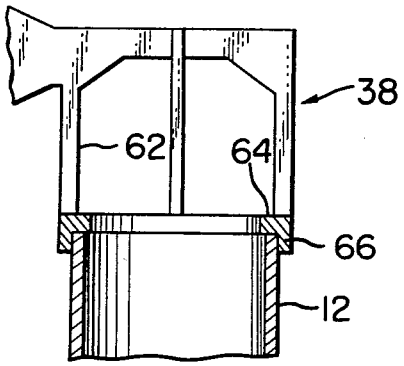
FIG. 6 is a relatively enlarged side elevational view, partly in section, of the sleeve mounting pusher in the apparatus of FIG. 5, the pusher being shown together with the printing sleeve being pushed thereby.

An inspection of both FIGS. 5 and 6 will make clear the configuration of the sleeve mounting pusher 38. It includes four upright, angularly spaced, parallel legs 62 interconnected at their top ends and having their bottom ends rigidly coupled to a ring 64 for abutment against the top end of the printing sleeve 12 during its mounting onto the core roll 14 on the roll holder 24. The ring 64 has a downturned rim 66 for externally engaging the printing sleeve 12. Thus the ring 64 essentially takes the form of a socket for relatively closely receiving the top end of the printing sleeve 12, thereby averting the risk of accidental disengagement.

Figure 7:
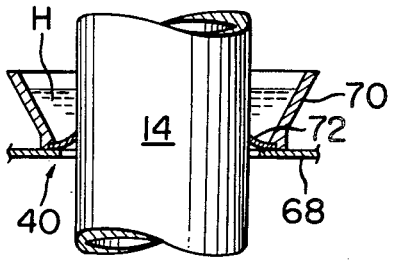
FIG. 7 is a relatively enlarged axial sectional view of the hotmelt applicator in the apparatus of FIG. 5, the applicator being shown coating the core roll with a hotmelt adhesive.

While the hotmelt applicator 40 appears in both FIGS. 5 and 7, the latter figure more aptly reveals its construction. The hotmelt applicator 40 is shown as an annular trough, open at its top and inside, encircling the core roll 14. Included are a bottom plate 68 in the form of a ring surrounding the core roll 14 with clearance, an outer side wall 70 of frustoconical shape fixedly mounted on the bottom plate so as to increase in diameter as it extends upwardly, and an annular lip 72 of elastic material secured along its outer edge to the bottom end of the side wall and having its inner edge arranged for sliding but fluid-tight contact with the core roll. The bottom plate 68 is fixed to the aforesaid lug 50 to be pin jointed to the bracket 48 of the lower carriage 36 on the guide column 32. When the applicator 40 is mounted around the core roll 14 as shown, the side wall 70, the lip 72, and the surface of the core roll define in combination the annular receptacle or trough for containing the hotmelt H in the molten state. The lip 72 may therefore be considered to form the bottom of the hotmelt receptacle. Thus, with the travel of the applicator 40 down the core roll 14, the hotmelt H can be applied uniformly over its entire surface.

The selection of a material for the lip 72 of the hotmelt applicator 40 deserves careful consideration for its successful operation. The lip should be resistant to heat and friction, should be relatively pliant, and must be self-biased into abutment against the core roll 14 under sufficient pressure to prevent the leakage of the molten adhesive. Preferred materials for the lip 72 include fluoroelastomer, silicone rubber, polyethylene, polypropyrene, and Teflon (trademark).

Reference is again directed to FIG. 5 in order to describe means for causing the up-and-down motion of the sleeve mounting pusher 38 and the hotmelt applicator 40. In the illustrated embodiment such means take the form of two steel cable drives associated with the respective carriages 34 and 36 on the guide column 32. The cable drives include two horizontally spaced idler pulleys 74 and 76 rotatably mounted on respective shafts 78 and 80 at the top of the guide column 32. Two drive pulleys 74' and 76' are rotatably supported on the pedestal 22 in vertical register with the respective idler pulleys 74 and 76. The output shafts of bidirectional motors 82 and 84 are coupled directly to the respective drive pulleys 74' and 76'. Extending around the two pairs of vertically spaced pulleys 74 and 74', and 76 and 76', are cables 86 and 88 with their opposite ends anchored to a lug 90 on the upper carriage 34 and to a lug 92 on the lower carriage 36, respectively. Consequently, with the bidirectional rotation of the drive motors 82 and 84, the carriages 34 and 36 and therefore the sleeve mounting pusher 38 and hotmelt applicator 40 travel up and down, either independently or simultaneously at equal speed.

Preferably, notwithstanding the example shown in FIG. 5, two pairs of vertically spaced pulleys should be provided for each of the carriages 34 and 36. Two cables extending around the respective pulley pairs may have their ends fastened to each carriage, in such a way that the carriage travels up and down as the two adjacent drive pulleys of the pulley pairs are simultaneously revolved in opposite directions. This alternative drive arrangement will serve to stabilize the up-and-down motion of the carriages.

Figure 8:
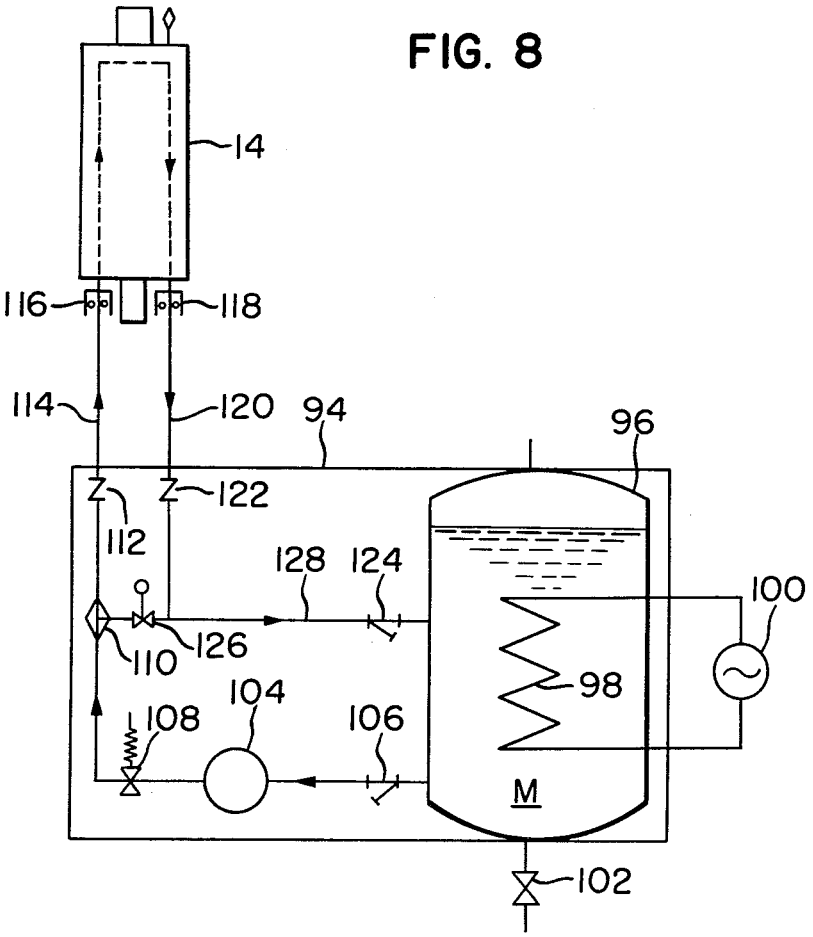
FIG. 8 is a diagrammatic representation of the means for heating the core roll during the assembly and disassembly of the gravure printing cylinder in the apparatus of FIG. 5.

FIG. 8 diagrammatically illustrates means for circulating a heating medium through the core roll 14 on the roll holder 24 in order to heat the roll during the mounting and dismounting of the printing sleeve 12 on and from the roll. The reference numeral 94 in this figure generally represents the system for the circulation of the heating medium, including a reservoir 96 containing the heating medium M such as oil or water. The reservoir 96 is provided with an electric heater 98, connected across a suitable current source 100, for heating the medium M contained therein. Also provided to the reservoir 96 is a drain valve 102 to be opened for the discharge of the heating medium as well as the sediment that may accumulate on its bottom.

A pump 104 draws the heating medium M from the reservoir 96 via a strainer 106 and forces the medium into the core roll 14 on the roll holder via a safety valve 108, three-way cock 110, check valve 112, conduit 114, and plug-in coupling 116. After flowing through the interior of the core roll 14 for heating the same to a desired temperature, the medium M returns to the reservoir 96 by way of a plug-in coupling 118, conduit 120, check valve 122, and strainer 124, to be reheated in the reservoir. A control valve 126 is connected between the cock 110 and a conduit 128 leading from the check valve 122 to the strainer 124. When this control valve is opened, the output from the pump 104 by-passes the core roll 14 and returns to the reservoir 96. Preferably, and as shown in FIG. 5, the conduits 114 and 120 should be provided with suitable lengths of bellows 130 and 132 to facilitate the manipulation of the plug-in couplings 116 and 118.

Figure 9:
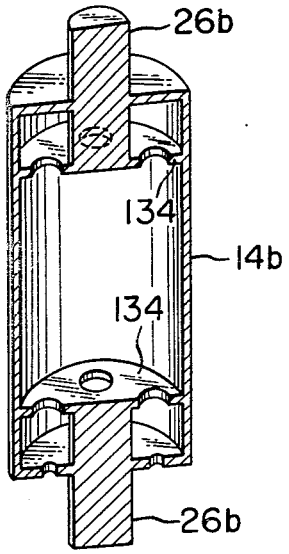
FIGS. 9, 10 and 11 are axial sectional views of different examples of the core roll suitable for use with the apparatus of FIG. 5.
Figure 10:
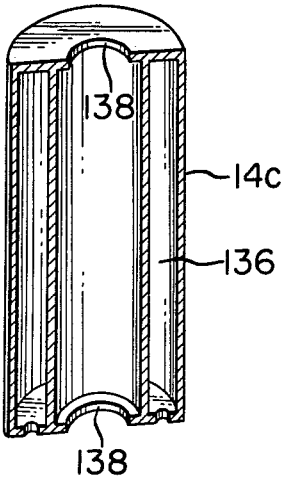
Figure 11:
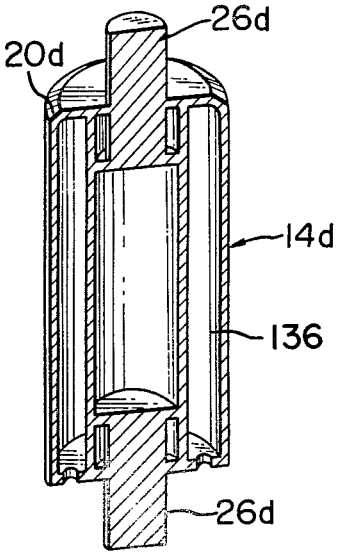

FIGS. 9, 10 and 11 show some different examples of the core roll to be heated by the fluid heating system 94 of FIG. 8. The core roll 14*b* of FIG. 9 is formed integral with a pair of journals 26*b* extending through the opposite end faces of the roll into its interior to be secured to perforated discs 134. This core roll is generally of fluid-tight construction, permitting the heating medium to fill its complete inner spaces. The core roll 14*c* of FIG. 10 is of dual wall arrangement, providing a tubular space 136 for the circulation of the heating medium. The dual wall construction offers the advantage of reducing the amount of the heating medium required for heating the surface of the core roll to a given temperature. The opposite end faces of the core roll 14*c* are bored at 138 for the passage of a separate shaft (not shown). The core roll 14*d* of FIG. 11 is a hybrid of the two preceding rolls 14*b* and 14*c*, integrally having a pair of journals 26*d* and being of dual wall construction. This roll is also shown to have a bevel 20*d* described in connection with FIG. 2.

Figure 12:
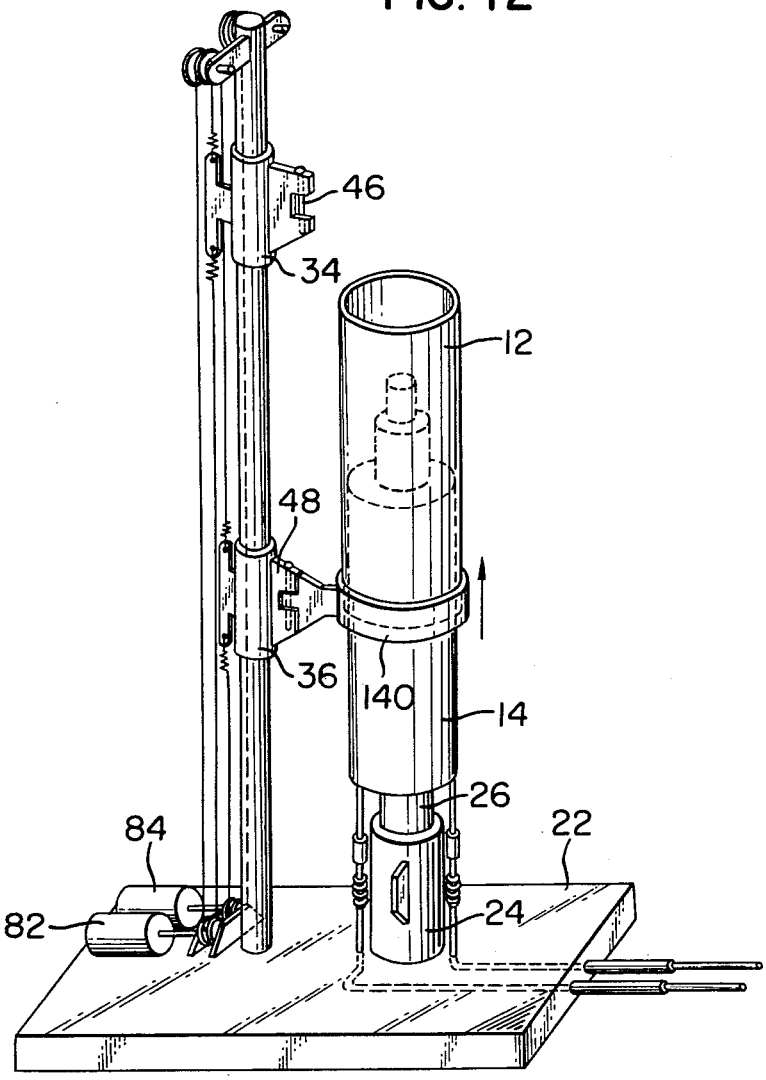
FIG. 12 is a view similar to FIG. 5 but showing the apparatus as conditioned for disassembly of the gravure printing cylinder and in the act of dismounting the printing sleeve from the core roll.

In FIG. 12 is shown the apparatus of FIG. 5 as equipped for disassembling the gravure printing cylinder after its use. Both sleeve mounting pusher 38 and hotmelt applicator 40 are removed from their carriages as they are unnecessary during disassembly. Instead, a sleeve dismounting pusher 140 hereinafter described is mounted on the lower carriage 36. The pusher 140 need not be mounted on the lower carriage 36 but may be mounted on the upper one 34, nor is it required to remove both sleeve mounting pusher 38 and hotmelt applicator 40 from the carriages. For instance, when the sleeve dismounting pusher 140 is mounted on the lower carriage 36 as shown, the sleeve mounting pusher 38 may be held mounted on the upper carriage 34 and turned about the pivot pin 46 to a position where it will not interfere with the disassembly of the gravure printing cylinder by the pusher 140.

Figure 13:
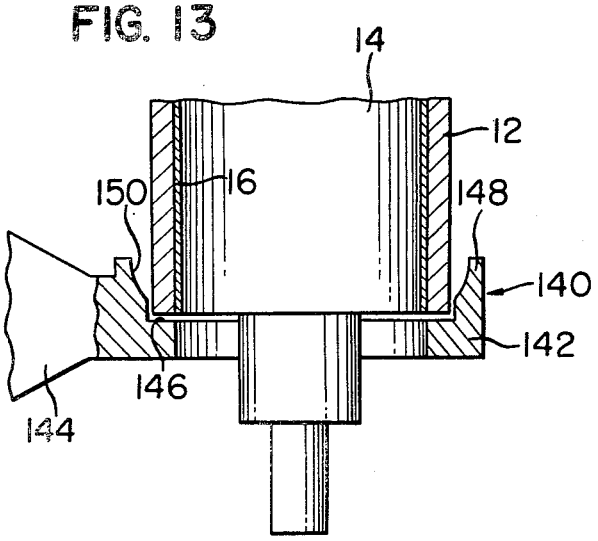
FIG. 13 is a relatively enlarged axial sectional view of the sleeve dismounting pusher used in the apparatus for disassembly of the gravure printing cylinder, the pusher being shown together with the printing sleeve being pushed up thereby.

As illustrated on an enlarged scale and in axial section in FIG. 13, the sleeve dismounting pusher 140 includes a ring 142. Integral with this ring is a lug 144 extending radially outwardly therfrom for pivotal connection to the bracket 48 of the lower carriage 36 (or to the bracket 42 of the upper carriage 34). The ring 142 provides an annular abutment 146 for direct contact with the bottom end of the printing sleeve 12 of the upstanding gravure cylinder on the roll holder 24. Also formed integral with the ring 142 is an upturned rim 148 for externally engaging the printing sleeve 12. The inside edge of this rim is countersunk at 150 for guiding the pusher 140 into axial alignment with the cylinder as the abutment 146 comes into contact with the end of the printing sleeve 12. The countersink 150 terminates short of the abutment 146, so that part of the rim 148 externally engages the printing sleeve 12 to hold the abutment 146 in proper contact with the sleeve. The abutment 146 must contact only the bottom end of the printing sleeve 12, and not with that of the core roll 14; therefore, the radial dimension of this abutment should not exceed the thickness of the sleeve.

The sleeve dismounting pusher 140 is fabricated from steel or like rigid, strong material, and at least its inner surfaces are preferably coated with heat-resistant plastics such as Teflon (trademark). Such coating will serve the dual purpose of protecting the pusher 140 from the heat applied to the core roll 14 and of minimizing the risk of damage to the printing sleeve 12.

Figure 14:
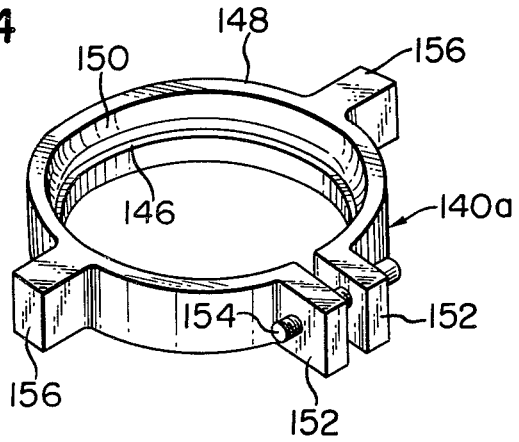
FIGS. 14 and 15 are perspective views of different alternative forms of the sleeve dismounting pusher.

FIG. 14 illustrates a modification of the sleeve dismounting pusher. The modified pusher 140*a* differs from the pusher 140 in having opposed ends 152, which are bent radially outwardly, instead of being in the form of a continuous ring. An adjusting screw 154 threadedly extends through these bent ends 152, making possible the fine adjustment of the inner diameter of the pusher. An additional feature of this modified pusher is a pair of grips 156 formed in diametrically opposed positions thereon and extending radially outwardly therefrom for ease of handling. The other details of construction of the modified pusher 140*a* are identical with those of the original pusher 140.

Figure 15:
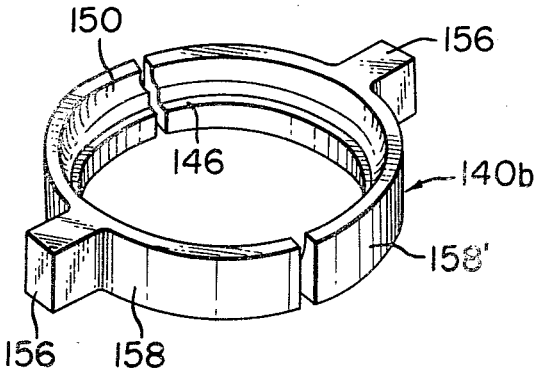

FIG. 15 shows another modified sleeve dismounting pusher 140*b*, which consists of two separate halves 158 and 158*i*. These pusher halves are urged against the printing sleeve by means such as springs or air cylinders coupled to the grips 156.

Operation

For assembling the gravure printing cylinder by means of the apparatus fitted out as depicted in FIG. 5, the core roll 14 is first mounted upstandingly on the roll holder 24 by engaging one of its journals 26 therein. Then the conduits 114 and 120 of the heating system 94 (FIG. 8) are placed in communication with the interior of the core roll 14 via the plug-in couplings 116 and 118 for heating the core roll with the heating medium M. Both the sleeve mounting pusher 38 and the hotmelt applicator 40 are held higher than the positions of FIG. 5 during the mounting of the core roll 14 on the roll holder 24. If necessary, the pusher 38 and the applicator 40 may be turned about the pivot pins 46 and 52, or may be removed from the carriages 34 and 36, so as not to interfere with the mounting of the core roll 14.

The tube 30 is fitted beforehand over the fins 28, just under the core roll 14, before this roll is mounted on the roll holder 24. The tube 14 may be normally held lowered onto the pedestal 22 and raised to the position of FIG. 5 only at the time of assembly of the printing cylinder. The fins 28 may be made retractable to allow such up-and-down travel of the tube 30. Alternatively, instead of the fins 28, detachable pins or the like may be adopted for holding the tube 30 in its working position by being inserted into holes in the roll holder 24.

After the core roll 14 has been mounted on the roll holder 24, the hotmelt applicator 40 is fitted over the top end of the roll and moved down to an extent necessary to contain a required amount of the hotmelt H in the molten state. Then the printing sleeve 12 is placed over the top end of the core roll 14, and the sleeve mounting pusher 38 is manipulated into engagement with the top end of the sleeve as in FIG. 6. Now the apparatus is ready to push the printing sleeve 12 down onto the core roll 14. The two drive motors 82 and 84 are set into rotation in directions to cause downward travel of the carriages 34 and 36. FIG. 5 shows the sleeve mounting pusher 38 and the hotmelt applicator 40 halfway down in their stroke.

As the hotmelt applicator 40 travels down the core roll 14, the hotmelt H contained therein remains molten by heat transfer from the roll and so is applied uniformly onto its surface. The applicator itself may be equipped with a suitable heater to maintain the molten state of the hotmelt. The lip 72 of the hotmelt applicator 40 is self-biased into abutment against the core roll 14, so that with the downward travel of the applicator, the lip serves the secondary purpose of wiping the roll clean of dust, ink and other foreign matter. The thickness of the lip may vary from several hundred microns to several millimeters depending upon its material. Generally, the thicker the lip, the greater will be the extent to which it is self-biased into contact against the core roll.

The heating system 94 of FIG. 8 heats the core roll 14 to a preferred temprature range of 60°–150° C. The core roll 14 is heated for the dual purpose of maintaining the hotmelt H in the molten state and causing thermal expansion of the printing sleeve 12. The hotmelt H is ordinarily less than 10,000 centipoises in viscosity, and the applicator 40 coats the heated core roll 14 with the adhesive by descending at a speed ranging from 1 to 100 cm/min. Applied under these conditions, the adhesive coating on the core roll will have a thickness ranging from five to 50 microns, desirably from 15 to 30 microns.

Immediately after or almost concurrently with the coating of the core roll 14 with the hotmelt, the printing sleeve 12 descends onto the roll, either under its own weight (usually less than 1 kg) or by the force of several kilograms. The downward force required for such descent of the printing sleeve 12 depends greatly upon the relative diameters of the sleeve and roll, the temperature to which they are heated, and the viscosity of the molten adhesive. The printing sleeve will encounter increasing resistance as it fits over the core roll more and more. However, the force required for pushing down the printing sleeve will not usually exceed 50 kg even if the gravure printing cylinder being assembled is of large size. The printing sleeve is lowered at a constant distance from the hotmelt applicator. The descending printing sleeve scrapes excess amount of the hotmelt off the core roll, causing such excess hotmelt to drip down the roll back into the applicator. The remainder of the hotmelt coating forms a layer of minimum required thickness between sleeve and roll.

The assembling of the gravure printing cylinder in the upright disposition, as in this embodiment, makes it possible for the printing sleeve to slip at least initially onto the core roll under its own weight. Provision may be made as required for slowly revolving the core roll 14 about its own axis during the mounting of the printing sleeve 12 thereon. Such revolution of the core roll will make more uniform the thickness of the adhesive layer between sleeve and roll. The adhesive layer is shown at 16 in FIGS. 1 and 2.

When the printing sleeve 12 completely covers the core roll 14, the heating system 94 is placed out of fluid communication with the core roll to stop its heating. The gravure printing cylinder thus assembled is allowed to stand until the hotmelt sets sufficiently. The hotmelt applicator 40 is then situated around the short tube 30 forming the downward extension of the core roll 14. Thus the tube 30 functions to prevent the hotmelt H from flowing out of the applicator 40 when the latter travels down past the bottom end of the core roll. The applicator 40 around the tube 30 catches the hotmelt that may stream down from the assembled printing cylinder during its cooling.

Such being the function of the tube 30, its outside diameter should be equal to or only slightly less than that of the core roll 14, and its surface should allow easy removal of the adhesive that may adhere thereto. This purpose is attainable, for example, either by wrapping a sheet of silicone rubber around the tube or by coating its surface with a release agent such as a silicone.

Following the assembly of the gravure printing cylinder as described above, the core roll 14 is emptied of the heating medium as by forcing air thereinto from its top. Then, with the sleeve mounting pusher 38 disengaged from the printing sleeve 12 and pivoted out of vertical register with the printing cylinder, the latter is withdrawn from the apparatus by means such as a hoisting machine. The printing cylinder can be put to use upon complete cooling.

As has been mentioned in connection with the method of this invention, the core roll 14 and/or the printing sleeve 12 can be heated and coated with a hotmelt in various ways other than those adopted in the embodiment of FIG. 5. The heating and coating ways of the FIG. 5 embodiment are preferred, however, because of the quickness of assembly, the uniformity with which the core roll is heated and coated, and the constancy of the roll temperature. Further, the fitting of the printing sleeve over the core roll immediately after the application of the adhesive on the latter, as in this embodiment, contributes to a firmer union therebetween. Such being the construction of the hotmelt applicator 40, moreover, the core roll need not be held exactly perpendicular to the horizontal plane during assembly.

The following is an operational description, with reference directed principally to FIG. 12, of the apparatus in the disassembly of the gravure printing cylinder after its use. Preparatory to the mounting of the printing cylinder on the apparatus, at least either of the sleeve mounting pusher 38 and the hotmelt applicator 40 is removed from the carriage 34 or 36. Then the sleeve dismounting pusher 140 is mounted on the empty carriage, whichever it is, and lowered therewith to a position lower than the bottom end of the printing cylinder to be subsequently mounted on the apparatus. Then the printing cylinder is placed upstandingly on the roll holder 24, with one of its journals 26 engaged therein and locked against detachment. The tube 30 of FIG. 5 may either be removed from around the roll holder 24 or held lowered onto the pedestal 22.

The next step is the heating of the gravure printing cylinder. The heating system 94 of FIG. 8 is placed in communication with the interior of the core roll 14 via the plug-in couplings 116 and 118, and the heating medium M is circulated through the core roll to heat same to the preferred temperature range of 60°–150° C. Thus heated, the adhesive layer between the sleeve and roll of the printing cylinder will melt, and the sleeve and roll will expand to different diameters. Then the sleeve dismounting pusher 140 is raised into abutment against the bottom end of the printing sleeve 12, as illustrated in FIG. 13. The annular abutment 146 of the pusher 140 will readily make proper contact with the bottom end of the printing sleeve 12 as the countersunk surface 150 of the pusher relatively guides the sleeve down onto the abutment.

Then the drive motor 82 or 84, whichever is coupled to the carriage 34 or 36 carrying the sleeve dismounting pusher 140, is set into rotation in the direction to raise the pusher. FIG. 12 shows the printing sleeve 12 half withdrawn from over the core roll 14 by the pusher 140. The rate of withdrawal will normally average 10 cm or more per minute. The upward force required for the withdrawal will initially be up to 50 kg but will decrease with the progress of the withdrawal. With the upward travel of the printing sleeve, therefore, the rate of withdrawal may be increased, for instance to 50–100 cm/min. Hydraulic cylinders or like actuators might be used for such sleeve withdrawal at increasing speed.

Upon removal from the core roll 14, the printing sleeve 12 is unloaded from the pusher 140, and the circulation of the heating medium through the roll is terminated. Then, after the discharge of the heating medium from within the core roll 14, the conduits 114 and 120 of the heating system 94 are disconnected therefrom. Subsequently the inside surface of the printing sleeve is cleaned of the hotmelt either by being sprayed with a suitable solvent, by dipping the sleeve in a solvent bath, or by ultrasonic cleaning. The cleaned sleeve may be put into a suitable enclosure and placed in storage pending a reorder. The core roll, on the other hand, may be scraped clean of the hotmelt as with a squeezer, as required, and placed in storage, or a new printing sleeve may immediately be fitted thereover through the above described procedure.

Modifications

Figure 16:
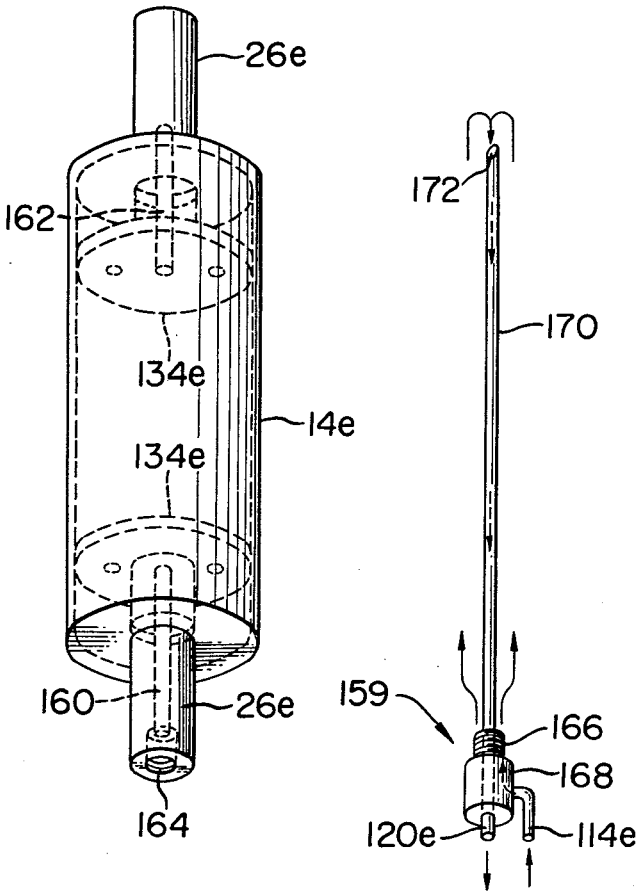
FIG. 16 is a perspective view of an additional example of the core roll, shown together with a plug assembly for use in heating the core roll with a heated fluid.

FIG. 16 shows an additional example **14*e* of the core roll to be heated by the heating system 94 (FIG. 8) as well as a plug assembly 159 for placing the core roll in and out of fluid communication with the heating system. The core roll 14*e* is largely of the type illustrated in FIG. 9, having a pair of journals 26*e* extending through its opposite end faces into its interior and secured to perforated discs 134*e*. The lower one of these journals has a bore 160 formed axially therethrough, whereas the upper one has a bore 162 extending upwardly from its bottom end and terminating short of its top end. The bottom end of the lower journal is formed into an internally threaded socket 164 in communication with the interior of the core roll 14*e* via the bore 160**.

The plug assembly 159 includes a plug body 168 having an externally threaded, reduced diameter portion 166 to be engaged in the socket 164 of the core roll **14*e*. The plug body 168 has an inlet conduit 114*e* and an outlet conduit 120*e* coupled thereto. The inlet conduit 114*e* communicates with an inlet port or ports formed in the top of the threaded portion 166 of the plug body 168. The outlet conduit 120*e* communicates with a straight, rigid conduit 170 extending upwardly from the threaded portion 166 and terminating in an outlet port 172. The rigid conduit 170 is adapted to be inserted with clearance into and through the bore 160 in the lower journal 26*e* and further into the bore 162 in the upper one, and the plug body 168 is screwed into the socket 164**.

Thus the heating medium M from the heating system 94 (FIG. 8) enters the core roll **14*e* from the plug body 168 and through the bore 160 in the lower journal. After filling the interior of the core roll 14*e*, the heating medium flows into the rigid conduit 170 through the outlet port 172 at its top to be directed back into the heating system 94 by way of the outlet conduit 120*e*. In this manner, since the heating medium is introduced into the core roll and discharged therefrom through one and the same plug body 168**, the various parts of the roll can be heated to an unvarying temperature. This heating scheme also offers the advantage of dispensing with an air vent valve that would otherwise have to be provided at the top of the core roll.

Figure 17:
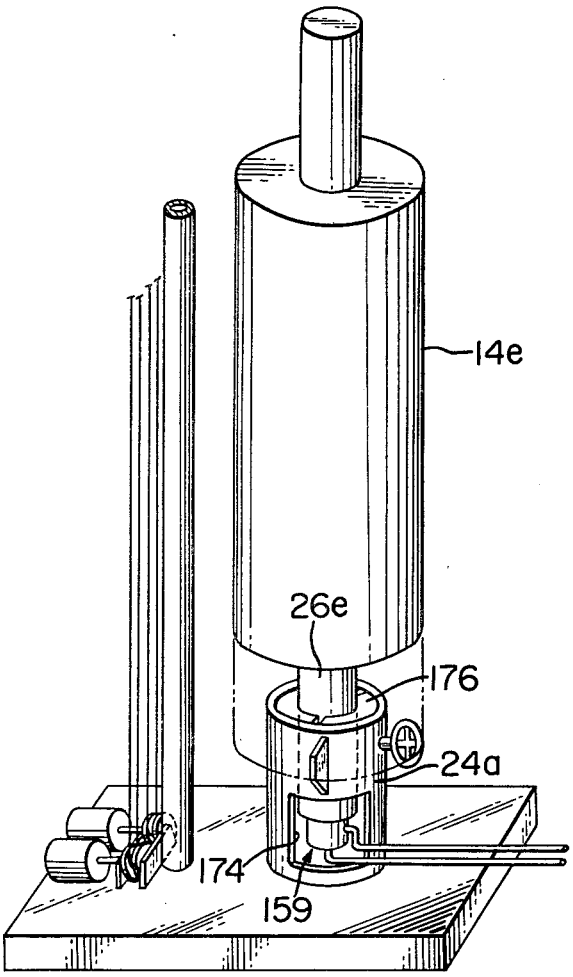
FIG. 17 is a partial perspective view of a modification of the apparatus for the assembly and disassembly of the gravure printing cylinder, the modified apparatus being intended for use with the core roll and plug assembly of FIG. 16.

FIG. 17 is a partial illustration of apparatus for mounting and dismounting a printing sleeve on and from the core roll **14*e* of FIG. 16, showing the core roll placed on a modified roll holder 24*a*. This roll holder has a window 174 through which the plug body 168 of the plug assembly 159 can be screwed into and unscrewed from the socket 164 of the core roll 14*e*. Seen at 176 is a chuck built into the roll holder 24*a* for gripping one of the journals 26*e* of the core roll 14*e*. The other details of construction of this modified apparatus can be as set forth above with particular reference to FIG. 5**.

Figure 18:
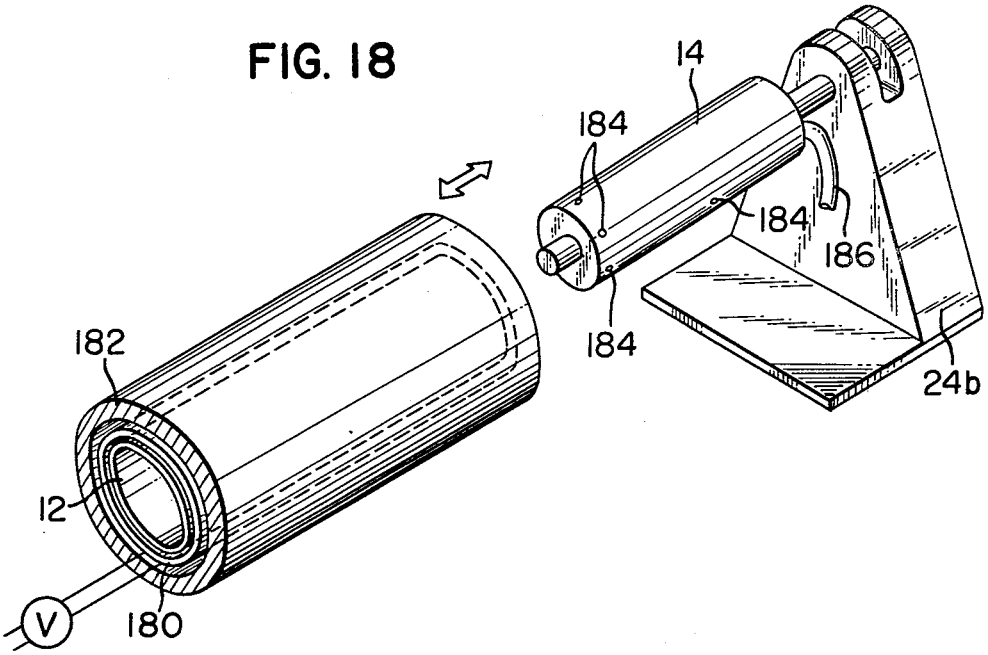
FIG. 18 is a perspective view schematically illustrating another possible modification of the apparatus.

It is to be understood that the core roll need not necessarily be held in an upstanding attitude during the assembly and disassembly of the gravure printing cylinder in accordance with the invention. Thus, in FIG. 18, the core roll 14 is supported horizontally in a cantilever fashion with one of its journals engaged in a roll holder **24*b*. It is also possible to heat the printing sleeve 12 instead of the core roll 14. In FIG. 18 the printing sleeve 12 is heated by a tubular electric heater 180 loosely surrounding the sleeve and itself enclosed in a tubular heat insulator 182. This figure also shows several small holes 184 formed in the core roll 14 for emitting air at room or elevated temperature to expedite the mounting and dismounting of the printing sleeve 12. Such air is forced into the core roll through a conduit 186** coupled to one of its ends.

Figure 19:
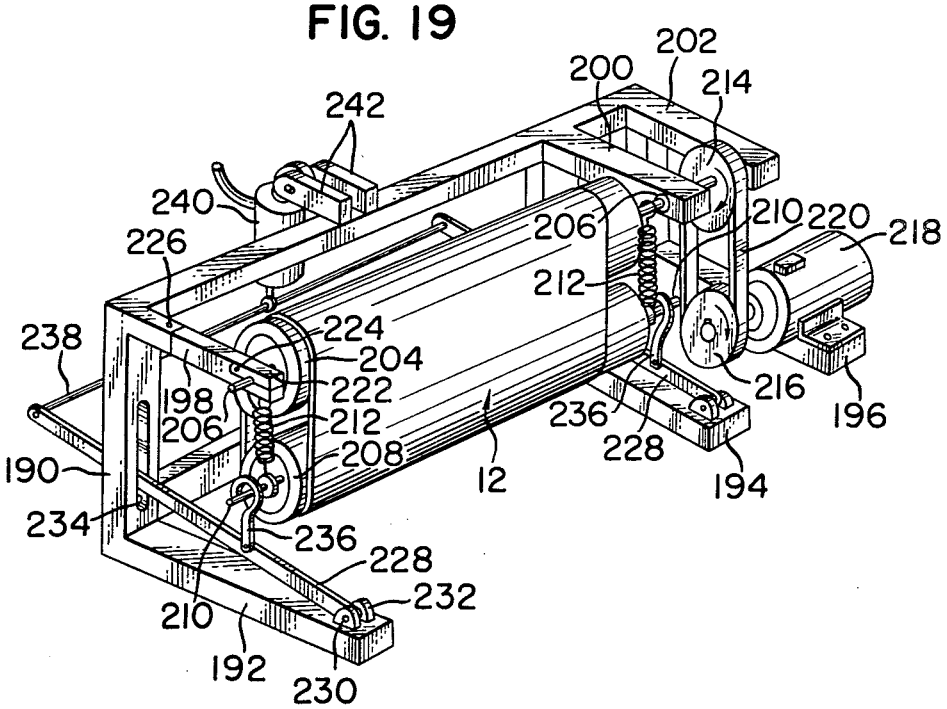
FIG. 19 is a perspective view of a device for exerting circumferential tensile stress on the printing sleeve preparatory to its mounting on the core roll.

Described hereinbelow by way of reference are several examples of means for temporarily exerting circumferential tensile stress on the printing sleeve preliminary to its mounting on the core roll. FIG. 19 illustrates one such tensioning device, which includes a frame 190 supported by three recumbent legs 192, 194 and 196 and having three arms 198, 200 and 202 extending horizontally from its top in parallel spaced relationship. A drive roll 204 is rotatably supported between the arms 198 and 200 by a rotatable shaft 206. Disposed under the drive roll 204 and parallel thereto is a tensioning roll 208 which is mounted on a shaft 210 suspended from the drive roll shaft 206 via a pair of tension springs 212. The printing sleeve 12 to be tensioned is wrapped around the drive roll 204 and tensioning roll 208. Both rolls 204 and 208 have coverings of rubber or like elastic material to minimize the risk of damage to the sleeve.

The shaft 206 of the drive roll 204 extends through the arm 200 and is rotatably journaled in a bearing, not shown, mounted to the arm 202. A driven pulley 214 is fixedly mounted on this extension of the drive roll shaft 206, whereas a drive pulley 216 is mounted directly on the output shaft of a drive motor 218. An endless belt 220 extends around the pulleys 214 and 216 to transmit the rotation of the drive motor 218 to the drive roll 204. For the ease of mounting and dismounting of the drive roll 204 and the printing sleeve 12, the distal end of the arm 198 is formed into a pair of jaws 222, the upper one of which is pivotable about a horizontal pivot pin 224. These jaws releasably engage one end of the drive roll shaft 206 therebetween. Further the arm 198 is made bendable about a vertical pivot pin 226.

A pair of load levers 228 are pivotally mounted each at one end on one of the recumbent legs 192 and 194 with pins 230 through lugs 232. The load levers 228 extend with clearance through slots 234 in the frame 190. Midway between the ends of each load lever 228 there is connected a hook 236 in engagement with the tensioning roll shaft 210. A rod 238 interconnects the free ends of the two load levers 228. A single acting hydraulic cylinder 240 is operatively connected between this rod and a pair of brackets 242 secured to the top of the frame 190.

In the use of this tensioning device the printing sleeve 12 is mounted around the two rolls 204 and 208 as shown. As has been mentioned in conjunction with the method of this invention, the printing sleeve is formed by electroplating a mother cylinder to a thickness of 100–600 microns and is subjected to circumferential tensile stress by this device immediately following its withdrawal from over the mother cylinder. After the mounting of the printing sleeve as described above, the drive motor 218 is set into motion to rotate the drive roll 204, and at the same time the hydraulic cylinder 240 is extended to push down the pair of load levers 228. Thus the tensioning roll 208 travels away from the drive roll 204 against the forces of the tension springs 212 to exert circumferential tensile stress on the printing sleeve 12. Such stress can be applied uniformly to all parts of the printing sleeve since the latter revolves around the rolls 204 and 208.

Figure 20:
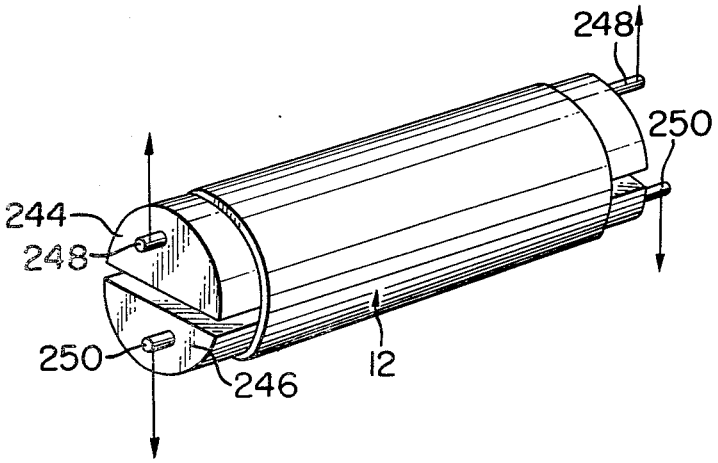
FIG. 20 is a perspective view explanatory of another method of exerting such stress on the printing sleeve.

FIG. 20 illustrates a different tensioning scheme in which the printing sleeve 12 is wrapped around a pair of semicylinders 244 and 246. Each semicylinder has a pair of pins 248 and 250 projecting from its opposite ends. The printing sleeve 12 receives circumferential tensile stress as the two pairs of pins 248 and 250 are moved apart from each other. In the practice of this scheme the pins 248 and 250 may be slidably engaged in guide grooves or slots.

Figure 21:
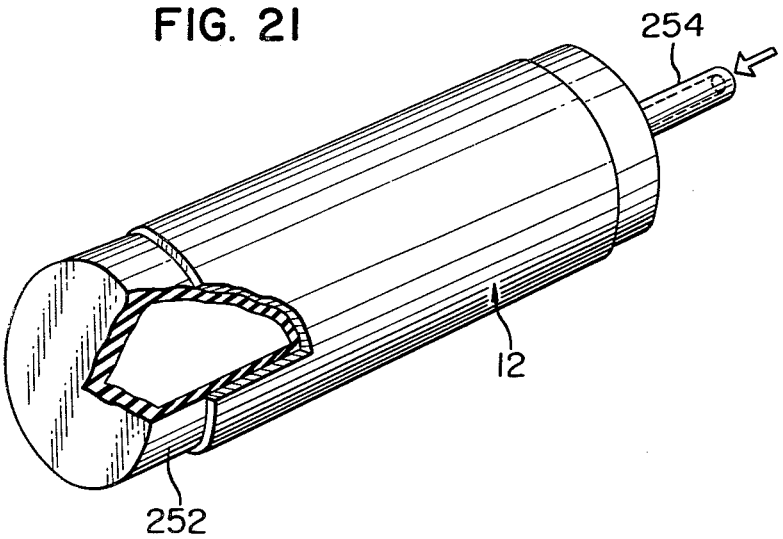
FIG. 21 is a perspective view, partly broken away for clarity, explanatory of still another method of exerting such stress on the printing sleeve.

Still another different tensioning scheme of FIG. 21 uses a hollow cylinder 252 of elastic material having a port 254 for the admission and discharge of a gas or liquid. The printing sleeve 12 is relatively closely fitted over the hollow, elastic cylinder 252. On being supplied with a suitable fluid under pressure the cylinder 252 expands in diameter to exert circumferential tensile stress on the printing sleeve 12. Instead of one hollow cylinder a suitable number of such cylinders may be laid parallel to each other, and the printing sleeve may be wrapped around these cylinders.

Whichever scheme is adopted, the tensile stress applied to the printing sleeve should be constant in its longitudinal direction. The maximum load to be exerted on the printing sleeve depends upon its thickness, axial dimension, structural design and other factors, but the length of time during which the sleeve is loaded is normally arbitrary.

We claim:

1. A method of assemblying a gravure printing cylinder, which comprises preparing a printing sleeve by electroforming, subjecting the printing sleeve temporarily to circumferential tensile stress, releasing the sleeve completely from the tensile stress, providing a core roll, applying a hotmelt adhesive in the molten state onto at least part of at least one of the surface of the core roll and the inner surface of the printing sleeve which has been subjected to, and released from, the tensile stress, and fitting thereafter the printing sleeve over the core roll while the hotmelt adhesive is in the molten state, the core roll and the printing sleeve being firmly bonded together upon solidification of the hotmelt adhesive to provide the gravure printing cylinder.

2. A method of assembling a gravure printing cylinder according to claim 1, wherein the circumferential tensile stress is less than the proportional limit of the printing sleeve.

3. A method of assembling a gravure printing cylinder according to claim 1, wherein the hotmelt adhesive has a Shore hardness of less than about A60° on setting.

4. A method of assembling a gravure printing cylinder according to claim 1, wherein the printing sleeve has an inner diameter less than the diameter of the core roll at room temperature, and wherein the printing sleeve in being mounted on the core roll is heated to such a temperature that the inner diameter of the printing sleeve becomes at least approximately equal to the diameter of the core roll.

5. A method of assembling a gravure printing cylinder according to claim 1, wherein the printing sleeve is made of a material having a higher coefficient of thermal expansion than the material of which the core roll is made, wherein the printing sleeve has an inner diameter less than the outside diameter of the core roll at room temperature, and wherein, in mounting the printing sleeve on the core roll, both the printing sleeve and the core roll are heated to such a temperature that the inner diameter of the printing sleeve becomes at least approximately equal to the diameter of the core roll.

6. A method of assembling a gravure printing cylinder according to claim 5, wherein heat is applied directly only to the core roll, and wherein the printing sleeve is heated by heat transfer from the core roll.

7. A method of assembling a gravure printing cylinder according to claim 6, wherein the core roll is heated by circulating a heating medium therethrough.

8. A method of assembling a gravure printing cylinder according to claim 1, wherein air is emitted from holes formed in the core roll during the mounting of the printing sleeve on the core roll.

9. A method of assembling a gravure printing cylinder according to claim 4, 5, 6 or 7, wherein the printing sleeve is processed to bear a gravure printing surface after being mounted on and bonded to the core roll.

10. A method of assembling a gravure printing cylinder according to claim 4, 5, 6 or 7, wherein the hotmelt adhesive in the molten state is applied onto the surface of the core roll while the core roll is held in an upright attitude, and the printing sleeve is fitted over the core roll from the top thereof.

* * * * *